US007654797B2

(12) United States Patent
Boegli et al.

(10) Patent No.: US 7,654,797 B2
(45) Date of Patent: Feb. 2, 2010

(54) BLADE WITH SHROUD

(75) Inventors: Andreas Boegli, Vogelsang-Turgi (CH); James Ritchie, Ennetbaden (CH)

(73) Assignee: Alstom Technology Ltd, Baden (CH)

( * ) Notice: Subject to any disclaimer, the term of this patent is extended or adjusted under 35 U.S.C. 154(b) by 206 days.

(21) Appl. No.: 11/682,624

(22) Filed: Mar. 6, 2007

(65) Prior Publication Data

US 2007/0231143 A1 Oct. 4, 2007

Related U.S. Application Data

(63) Continuation of application No. PCT/EP2005/054327, filed on Sep. 2, 2005.

(30) Foreign Application Priority Data

Sep. 8, 2004 (CH) ..... 01483/04

(51) Int. Cl.
*F01D 5/22* (2006.01)

(52) U.S. Cl. ..... 416/191

(58) Field of Classification Search ..... 416/191, 416/195, 196 R, 193 A, 193 R, 190, 500; 415/173.1, 134, 135, 138, 139, 173.6, 173.3, 415/174.2

See application file for complete search history.

(56) References Cited

U.S. PATENT DOCUMENTS

| | | | | |
|---|---|---|---|---|
| 2,772,854 | A | 12/1956 | Anxionnaz | |
| 3,185,441 | A | 5/1965 | Reuter | |
| 3,545,882 | A | 12/1970 | Williamson | |
| 3,771,922 | A | 11/1973 | Tracy | |
| 4,243,360 | A | 1/1981 | Wright et al. | |
| 5,238,366 | A * | 8/1993 | Ferleger | 416/61 |
| 2003/0012655 | A1 | 1/2003 | Sasaki et al. | |
| 2005/0089398 | A1 * | 4/2005 | Jutras | 415/139 |

FOREIGN PATENT DOCUMENTS

| | | |
|---|---|---|
| CH | 418360 | 8/1966 |
| DE | 1901464 | 8/1969 |
| FR | 1252763 | 5/1961 |

(Continued)

OTHER PUBLICATIONS

Translation of JP58162702A. Dec. 2008. Schreiber Tanslation, Inc.*

(Continued)

*Primary Examiner*—Richard Edgar
(74) *Attorney, Agent, or Firm*—Darby & Darby

(57) ABSTRACT

A blade for a turbo machine has a blade section and a shroud element terminating the blade section in the blade section longitudinal direction. The blade section has a suction face and a pressure face. The shroud element extends essentially at right angles to the blade section longitudinal direction and has a first platform section projecting beyond the blade section and a second platform section projecting beyond the blade section. The platform sections are asymmetric with respect to one another. At least the first platform section of the shroud element is arranged at an additional inclination angle with respect to a normal alignment of the first platform section, with the additional inclination angle being in the opposite direction to the bending torque which acts on the first platform section during operation.

15 Claims, 6 Drawing Sheets

FOREIGN PATENT DOCUMENTS

| | | | | |
|---|---|---|---|---|
| JP | 58162702 | A | * | 9/1983 |
| JP | 10339105 | | | 12/1998 |
| SU | 1059222 | | | 12/1983 |
| SU | 1087675 | | | 4/1984 |

OTHER PUBLICATIONS

International Search Report for International No. PCT/EP2005/054327 mailed on Dec. 6, 2005.

Search Report for Patent No. CH 014803/04 of Nov. 30, 2004 and brief translation.

* cited by examiner

BLADE WITH SHROUD

This application is a continuation of International Patent Application PCT/EP2005/054327, filed on Sep. 2, 2005 and claims priority to Swiss Patent Application CH 01483/04, filed on Sep. 8, 2004. The entire disclosure of both applications is incorporated by reference herein.

The present invention relates to a blade for a turbomachine equipped with a shroud, and to a blade arrangement having a plurality of blades, which are arranged on the circumference of a turbomachine in a row with respect to one another.

BACKGROUND

It is known per se from the prior art for blade rows of turbines to be equipped with shrouds. The shrouds may in this case, for example, be in the form of outer shrouds on the outer circumference of a blade row. The shrouds are also generally in the form of split shrouds, with the relevant shroud being subdivided on the circumference of a blade row into a large number of shroud elements corresponding to the number of blades in the blade row. Each blade then has one associated shroud element, with the blade and the shroud element generally being formed integrally. The shroud elements are generally in the form of platforms and extend essentially at right angles to the blade longitudinal direction. When the blades are arranged in a row on the circumference of a turbomachine, in a known manner, the shroud elements of the blades are thus adjacent to one another and thus form a shroud which is closed on the circumference. In the case of outer shrouds, the respective shroud element is located at the blade tip, that is to say at the free end of the blade section of the blade.

A shroud may be arranged on a blade row for various reasons. Firstly, the arrangement of a shroud makes it possible to improve the vibration behavior of a blade. Adjacent blades are coupled to one another by the split shroud elements in the area of the blade tips or in the area of the blade root. This on the one hand increases the oscillatory mass of the blade and thus changes the natural frequency behavior. A shroud which is arranged at the blade tips also acts like an additional form of clamping for the blade sections of the blade, thus fundamentally improving the oscillatory behavior. In addition, a shroud also makes it possible to increase the damping, since, when the blade is stimulated to oscillate, relative movements occur between the contact surfaces between the shroud elements, thus converting kinetic energy to thermal energy.

A further aspect is that the arrangement of shrouds reduces the leakage of the main flow. This is because the shroud forms a virtually closed flow channel wall which is sealed with respect to the housing located behind it, or else with respect to the shaft. In consequence, virtually no fluid from the main flow enters the intermediate space between the shroud and the housing, and thus cannot escape as a leakage flow through gaps in the housing, either.

The outer shroud elements of an outer shroud for a rotor are normally arranged at the blade section tip such that the center of gravity of the outer shroud is balanced in relation to the respective blade root. Since, however, modern blade sections are generally designed to be twisted and also curved in some cases, this means that the shroud elements are not symmetrically balanced. This means that one platform section of the shroud element, which extends on one side of the blade section (for example the pressure face), is not equal to the other platform section of the shroud element, which extends on the other side of the blade section (for example the suction face). In particular, the platform sections often have unequal projection lengths. This nonuniformity of the platform sections leads to bending torques of different magnitude on the pressure-side and suction-side platform sections when the blade is used in a rotor, owing to the centrifugal forces acting on the platform sections. The different bending torques in turn lead to different elastic deformation of the platform sections on the pressure side and suction side. This situation is illustrated in FIG. 4. The pressure-side platform section in FIG. 4 has a larger projection length than the suction-side platform section, and is subject to a greater bending torque during rotation, because of the higher mass and the longer lever arm, and this in turn leads to greater elastic deformation of the pressure-side platform section. The pressure-side platform section is in consequence bent to a greater extent than the suction-side platform section of the adjacent shroud element, thus resulting in a gap being produced between the pressure-side platform section and the suction-side platform section, through which fluid from the main flow can escape in the manner illustrated in FIG. 4. The escape of fluid through the resultant gap is further exacerbated here because the fluid is forced or pressed into the gap as a result of the rotation direction in the direction of the pressure face, in a similar manner to a blade effect.

In addition to the high bending forces, the shrouds, particularly for turbine stages, are often additionally subject to very high temperatures from the main flow. The combined load has a negative influence on the time/creepage behavior of the platform sections. Those platform sections which have a longer free projection length and in consequence are subject to a greater bending torque during operation are also deformed by an increased creepage behavior. The creepage behavior is in turn directly coupled to the projection length, and leads to an increase of the effect illustrated in FIG. 4.

As the component age increases, an increased amount of fluid escapes from the main flow through the gap as the gap size increases. Particularly in the turbine area, the fluid in the main flow is in this case at a very high temperature, resulting in a dramatic rise in the material temperature both on the rear face of the shroud and on the adjacent components. On the one hand, this once again leads to an increase in the creepage behavior described above, and on the other hand leads to an increased temperature load on the adjacent components. In some cases, even local material overheating occurs, so-called hot spots. In any case, this effect leads in some cases to a very considerable shortening of the life of virtually all of the components which are affected. A blade whose shroud has reached a specific creepage deformation is thus nowadays replaced at an early stage after only a short life, in order in this way to prevent further damage being caused.

SUMMARY OF THE INVENTION

An object of the invention is to provide a blade and blade arrangement of the type mentioned initially, by means of which one or more disadvantages of the prior art are reduced or avoided.

The invention contributes to increasing the lives of blades which are equipped with shrouds.

One particular aim of the invention is to at least reduce the formation of gaps between the shroud elements during operation of a blade arrangement in which a plurality of blades are arranged in a row, with the blades being equipped with shroud elements.

The blade according to the present invention has a blade section and a shroud element which terminates the blade section in the blade section longitudinal direction. The blade section in turn has a suction face and a pressure face. The shroud element, which is in the form of a platform, extends in a known manner essentially at right angles to the blade section longitudinal direction and has a first platform section, which projects beyond the blade section, as well as a second platform section, which projects beyond the blade section. The first platform section is expediently in the form of a pressure-side platform section, and the second platform section is expediently in the form of a suction-side platform section. The platform sections are asymmetric with respect to one another. The asymmetry of the platform sections means that a greater bending torque acts on the first platform section during operation of the blade than on the second platform section. Asymmetry such as this may, for example, be achieved by the platform sections having different projection lengths that are relevant for the bending torque. In the case of a blade which rotates during operation, the asymmetry may also be achieved by different material thicknesses of the platform sections. The projection length which is relevant to the bending torque of the pressure-side platform section is generally greater than the projection length which is relevant to the bending torque of the suction-side platform section, with a ratio of the projection length of the pressure-side platform section which is relevant to the bending torque to the projection length of the suction-side platform section which is relevant to the bending torque normally being more than 1.15.

In order to compensate for deflections of the platform sections which occur during operation of the blade, to such an extent that a gap which is as small as possible is produced between the shroud elements, the first platform section of the shroud element is, according to the invention, arranged at an additional inclination angle with respect to a normal alignment of the first platform section. The additional inclination angle is in this case in the opposite direction to the effective direction of the bending torque which acts on the first platform section during operation, and is thus also added to the deflection of the first platform section.

The expression normal alignment of a platform section is understood as meaning that alignment of the platform section which would occur with a purely geometric definition, that is to say the platform section is in this case aligned such that, when the shroud elements are arranged in a row, this results in an annular shroud with a closed circumference.

The alignment according to the invention of at least one platform section of a shroud element at an additional inclination angle, means, in the end, that the platform sections of the shroud element run at different angles to the perpendicular to the blade section longitudinal direction. Thus, in the area of the blade section, the shroud element effectively has a bend, with this bend preferably being rounded.

Since, according to the invention, at least one platform section of the shroud element of the blade designed according to the invention is arranged at an additional inclination angle with respect to a normal alignment, when the blade is arranged in a row with a further blade, for example in a rotor, a step is formed in the transition area between the shroud element of the blade designed according to the invention and the shroud element of the adjacent blade in the rest state. As a consequence of the inclination angle, the platform section which is arranged at an additional inclination angle projects, for example, to a greater extent into the flow channel than the platform section of the adjacent blade. Only when the rotor is in operation does the rapid rotation of the rotor result in centrifugal forces which act on those platform sections of the shrouds which lead to bending torques, by means of which the platform sections are bent in the direction of the effective bending torques. At the same time, the pressure within the flow leads to a further increase in the bending. This bending reduces the effective inclination of the platform section that is aligned according to the invention. Only a reduced effective additional inclination angle is thus now produced during operation of the blade, resulting in only a small step or no step at all between the adjacent platform sections. If a step remains between the adjacent platform sections, this is preferably designed such that the step falls in the direction of lower pressure. The shroud elements of adjacent blades are thus sealed considerably better during operation of the blades. This thus makes it possible to effectively prevent any inward flow of fluid from the main flow, in particular of hot gas in hot turbine flow, through gaps between the shroud elements into, for example, the cooling channel between the shroud and the housing or the shaft.

Furthermore, it has been found that the platform sections of the blades designed according to the invention furthermore also have a considerably reduced tendency to thermally dependent creepage. This is because the remaining gaps which are formed between adjacent shroud elements allow only a considerably reduced amount of hot fluid to enter a cooling channel, which runs between the shroud elements and the housing, or further gaps between the shroud elements and the housing or the shaft. The disadvantageous effect of the shroud element being additionally heated by this hot fluid entering the cooling channel or the gaps can thus be largely prevented. The shroud element is thus locally and overall at a lower temperature, so that thermally dependent creepage occurs only to a reduced extent.

Both the improved sealing of the shroud elements which is achieved by the invention and the reduced creepage tendency which is achieved overall in this way lead to a considerable increase in the life of all the components affected. The components affected, in particular the blade designed according to the invention, need in consequence not be replaced until a considerably later time in the course of overhaul of the turbomachine than in the case when using conventional blades, as known from the prior art. All of the blades in one stage are in this case preferably designed according to the invention. Particularly in a turbine, the arrangement of blades designed according to the invention thus leads to a considerable increase in the operating life of the turbine in comparison to a turbine equipped with conventional blades. Conversely, this allows the overall operating costs to be reduced considerably, or it would be possible to increase the hot-gas temperature, with the life of the blades remaining the same.

The blade designed according to the invention is particularly suitable for use as a rotor blade in a turbine in a turbomachine or a turbine set. High centrifugal forces, as well as high temperatures at the same time, occur specifically in the rotors of a turbine, and in this case lead to combined loads on the blades. In this case, the invention can thus contribute to a considerable increase in the life of the blades of the rotors.

It has been found that the invention can be used particularly expediently for a blade which is designed with a shroud element in the form of an outer shroud element. Particularly in the case of a rotor blade designed with an outer shroud element, the centrifugal forces which act on the rotor blade during operation result in bending of the platform section of the shroud element.

The shroud element may, however, also be in the form of an inner shroud element. In the case of a blade which is designed with an outer shroud element and an inner shroud element, the invention can also be applied to both shroud elements.

For many applications, it is expedient to align the pressure-side platform section of the shroud element at an additional inclination angle, in the manner according to the invention. In the case of a turbine, this means that the pressure-side platform section precedes the suction-side platform section of the shroud element of the adjacent blade in the rotation direction of the turbine. If an effective inclination angle of more than 0° remains between the pressure-side platform section and the suction-side platform section during operation, so that a step is formed in the transition from the pressure-side platform section to the suction-side platform section, then this step has a similar effect on the flow to that of a spillway. The flow flows over the step without being compressed on it.

The additional inclination angle should expediently be chosen such that an effective additional inclination angle of at least 0° is produced during operation of the blade.

An inclination angle of 0° means that the platform section which is arranged at an inclination angle abuts against the platform section of the adjacent blade without any step being formed. A positive inclination angle occurs when the platform section which is arranged at an inclination angle abuts against the platform section of the adjacent blade with a step being formed and the inclination angle is in the opposite direction to any bending torque which occurs on the platform section during operation.

According to one expedient refinement of the invention, the additional inclination angle is chosen such that an effective additional inclination angle of more than 0° is produced during operation of the blade. This means that, as long as the blade is relatively new, a step is formed between the shroud element of the blade under consideration and the shroud element of the adjacent blade during operation of the blade. Once the blade has been operated for a certain time, thermally dependent creepage and the plastic deformation of the shroud element resulting from this lead, however, to a reduction in the step and, finally, to the step disappearing completely. An undesirable step in the negative direction does not occur until after this, leading to an increase in the deformation process of the platform section. The overall life of a blade designed in this way with a positive additional inclination angle is, however, considerably increased in comparison to conventional blades.

The additional inclination angle is preferably chosen such that an effective additional inclination angle is produced during operation of the blade which is approximately equal to the additional inclination angle for which an additional effective inclination angle of 0° is produced. On the one hand, this makes it possible to considerably lengthen the life of the blade. On the other hand, the main flow is subject to only a minor disturbance, so that this does not result in any significant increase in the flow losses in the main flow.

According to one advantageous development of the invention, the blade is produced together with the shroud element as a casting. If the arrangement of the platform section at an additional inclination angle according to the invention is taken into account in the casting process itself, then this means that no additional costs, or only minor additional costs, are required for production of the blade designed according to the invention, in comparison to a conventional blade.

According to a further aspect of the invention, at least one of the blades in a blade arrangement which has a plurality of blades which are arranged in a row with respect to one another on the circumference of a turbomachine is or are designed in the manner according to the invention. The blade arrangement according to the invention is advantageously developed as a rotor for a turbine. The blade arrangement may, however, also be developed as a stator.

All of the blades in a blade arrangement such as this are advantageously designed in the manner according to the invention.

The platform sections of the shroud elements of the blades in the blade arrangement are expediently designed to be essentially rectangular at each of their free ends, with an edge facing the flow and an edge facing away from the flow.

The additional inclination angle can then expediently be chosen such that the edge facing away from the flow of that platform section which is arranged at an additional inclination angle is located between the edge facing the flow and the edge facing away from the flow of the adjacent platform section of the adjacent blade during operation of the blade arrangement.

According to one preferred refinement, the additional inclination angle is chosen such that the edge facing away from the flow of that platform section which is arranged at an additional inclination angle is located between the edge facing the flow and a center plane between the edge facing the flow and the edge facing away from the flow of the adjacent platform section of the adjacent blade during operation of the blade arrangement.

Furthermore, the additional inclination angle is expediently chosen such that the edge facing away from the flow of that platform section which is arranged at an additional inclination angle projects further into the area of the flow when the blade arrangement is not in operation than the edge facing the flow of the adjacent platform section of the adjacent blade.

BRIEF DESCRIPTION OF THE DRAWINGS

The present invention will be explained in more detail in the following text with reference to one exemplary embodiment, which is illustrated in the figures, in which.

The figures illustrate only those elements and components which are significant for understanding of the invention.

The illustrated exemplary embodiments should be regarded as being purely instructional and are intended to be used to assist understanding, but not as implying any restriction to the subject matter of the invention.

DETAILED DESCRIPTION

Figure 1:
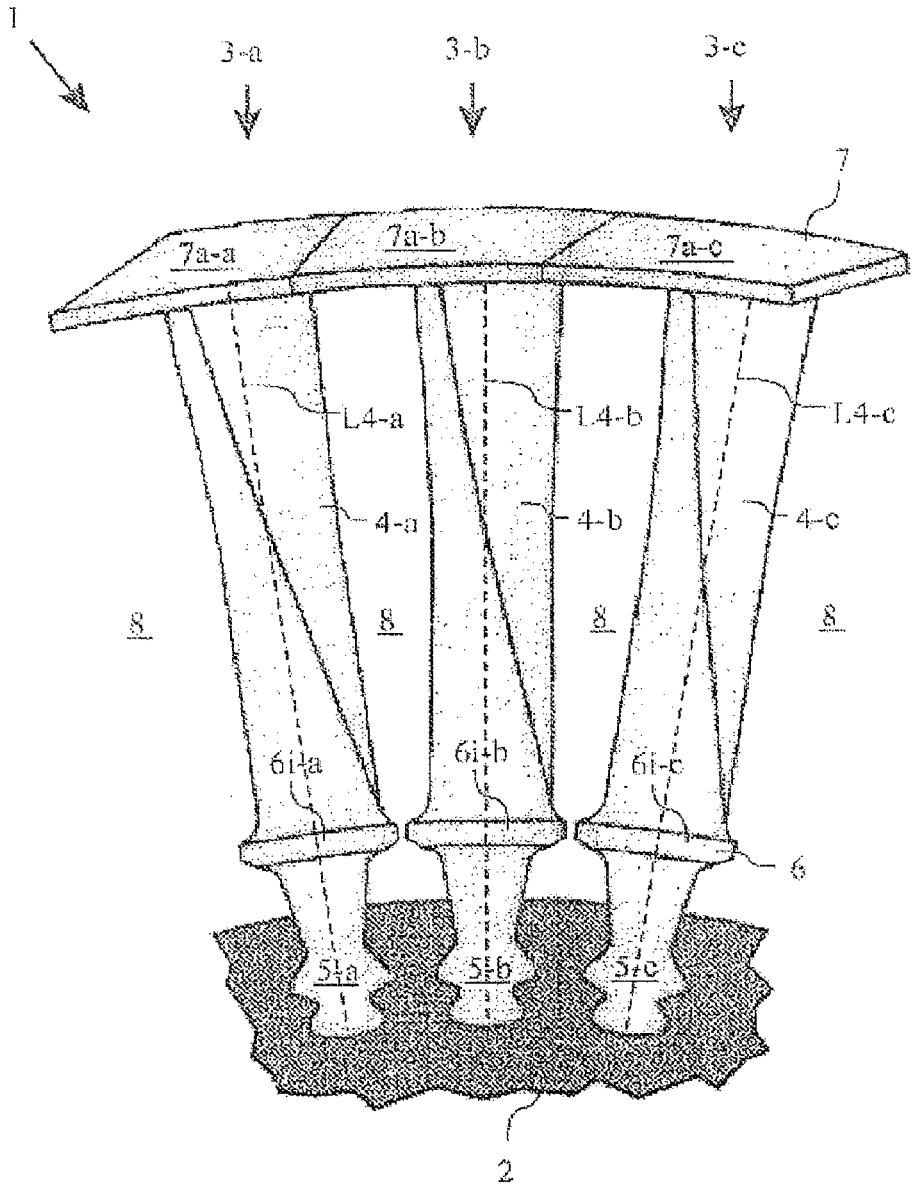
Fig. 1 PRIOR ART
FIG. 1 shows a detail of a rotor as known from the prior art and designed with an outer shroud.

FIG. 1 shows a schematic illustration of detail of a rotor 1 as known from the prior art, which is designed in a manner known per se with an inner shroud 6 and an outer shroud 7. The rotor 1 illustrated in FIG. 1 is in this case in the form of a rotor for a turbine.

The rotor 1 illustrated in FIG. 1 has a centrally arranged rotor shaft 2 and a plurality of blades 3-*a*, 3-*b* and 3-*c* arranged alongside one another on the circumference of the rotor shaft 2. The blades 3-*a*, 3-*b*, 3-*c* each have a blade section 4-*a*, 4-*b* and 4-*c*, respectively, and are anchored via firtree roots 5-*a*, 5-*b* and 5-*c* in the rotor shaft 2. A respective inner shroud element 6*i*-*a*, 6*i*-*b* and 6*i*-*c* is arranged between the respective firtree root 5-*a*, 5-*b* and 5-*c* and the blade section 4-*a*, 4-*b* and 4-*c* of each blade. The inner shroud elements 6*i*-*a*, 6*i*-*b* and 6*i*-*c* are each in the form of platforms and extend essentially at right angles to the respective blade section longitudinal direction L4-*a*, L4-*b* or L4-*c*. Furthermore, a respective outer shroud element 7*a*-*a*, 7*a*-*b*, 7*a*-*c* is located at the blade section tip of each blade 3*a*, 3*b*, 3*c*. The outer shroud elements 7*a*-*a*, 7*a*-*b*, 7*a*-*c* are also in the form of platforms and likewise extend essentially at right angles to the respective blade section longitudinal direction L4-*a*, L4-*b* or L4-*c*.

In the arrangement of the blades 3-*a*, 3-*b*, 3-*c* illustrated in FIG. 1 on the circumference of the rotor 1, the blades 3-*a*, 3-*b*, 3-*c* are positioned together with the shroud elements 6*i*-*a*, 6*i*-*b*, 6*i*-*c* and 7*a*-*a*, 7*a*-*b*, 7*a*-*c* such that the inner shroud elements 6*i*-*a*, 6*i*-*b*, 6*i*-*c* and the outer shroud elements 7*a*-*a*, 7*a*-*b*, 7*a*-*c* of adjacent blades 3-*a*, 3-*b*, 3-*c* are adjacent to one another and thus form an inner shroud 6, which is closed at the circumference of the rotor 1, as well as an outer shroud 7, which is closed at the circumference of the rotor. The inner shroud 6 and the outer shroud 7 on the one hand form the boundary of the flow channel 8. During operation of the turbine, the very hot air coming from the combustion chamber, which forms the main flow through the turbine, flows through the flow channel 8. On the other hand, the shroud elements 6*i*-*a*, 6*i*-*b*, 6*i*-*c* and 7*a*-*a*, 7*a*-*b*, 7*a*-*c* are, however, also used to change the oscillation behavior of the blades 3-*a*, 3-*b*, 3-*c* in a desired manner. One the one hand, the additional mass of the shroud elements 6*i*-*a*, 6*i*-*b*. 6*i*-*c* and 7*a*-*a*, 7*a*-*b*, 7*a*-*c* changes the natural frequency of the blades 3-*a*, 3-*b*, 3-*c* towards lower frequencies. On the other hand, the provision in particular of the outer shroud elements 7*a*-*a*, 7*a*-*b*, 7*a*-*c* also, however, changes the way in which the blade section is clamped in, such that the blade sections 4-*a*, 4-*b*, 4-*c* are clamped in at both ends. Furthermore, oscillation energy which, for example, has been transmitted from the flow to one of the blades 3-*a*, 3-*b* or 3-*c* can be dissipated by means of solid-body friction between adjacent shroud elements.

FIG. 1 does not illustrate a turbine casing, which is normally adjacent to the outer face of the outer shroud 7. Since, during operation of the turbine, the outer shroud 7 rotates with a high circumferential velocity, while, in contrast, the casing is stationary, a small gap must remain between the outer shroud 7 and the casing in order to allow such relative movement. In order, furthermore, to allow the outer shroud 7 to run slightly on the casing as a result of thermal expansion, the casing is also additionally often coated with an abrasive material, for example a honeycomb material, on the side facing the outer shroud. This makes it possible to restrict the gap between the outer shroud and the casing to a minimum.

Figure 2:
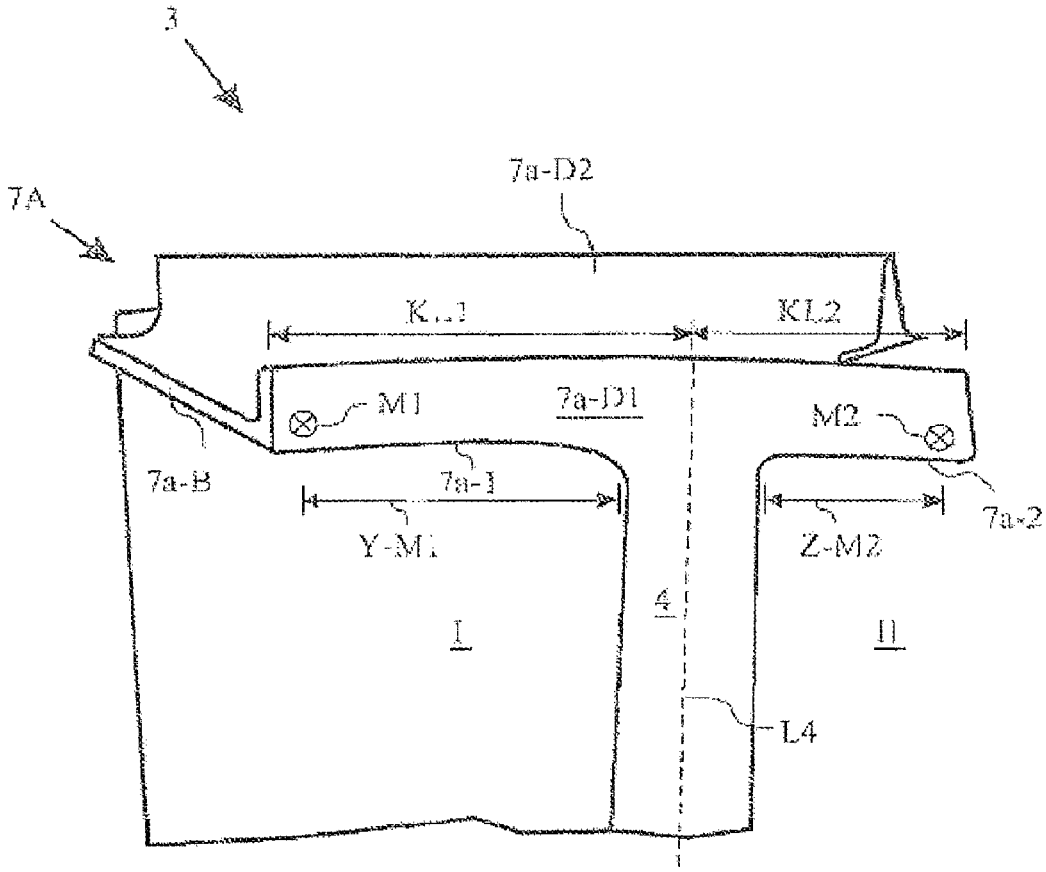
Fig. 2 PRIOR ART
FIG. 2 shows a detailed view of a rotor blade as known from the prior art and designed with an outer shroud element.
Figure 3:
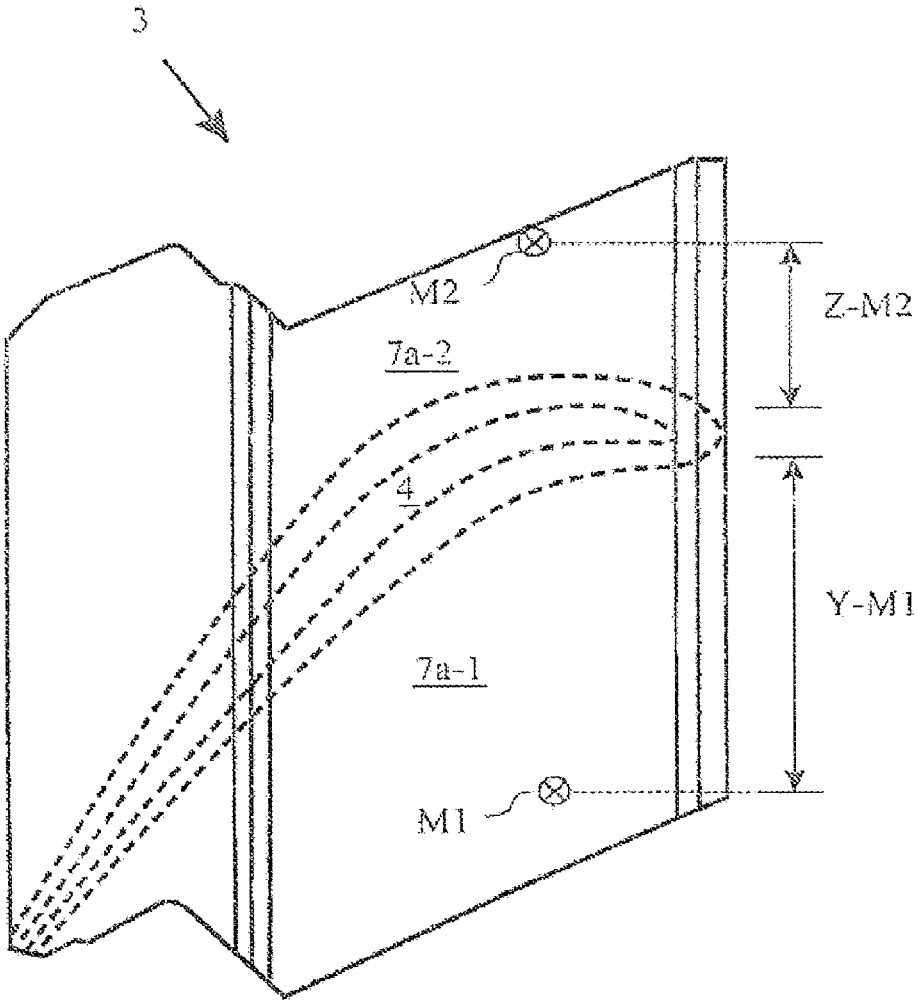
Fig. 3 PRIOR ART
FIG. 3 shows a plan view of the rotor blade designed with an outer shroud element as shown in FIG. 2.

FIG. 2 shows a plan view of a rotor blade 3 as is known from the prior art, and having an outer shroud element 7*a*. FIG. 3 shows a plan view of the rotor blade 3 from FIG. 2. The detail illustrated in FIG. 2 shows an upper section of the blade section 4. The blade section 4 has a pressure face I and a suction face II. The outer shroud element 7*a* terminates the blade section 4 at the upper end of the blade section 4. The outer shroud element 7*a* extends approximately at right angles to the blade section longitudinal direction L4, and is essentially in the form of a platform. In this case, in addition, a sealing lip 7*a*-D1 and 7*a*-D2 is in each case arranged on the front face and on the rear face of the shroud element 7*a* and extends from a base platform 7*a*-B of the shroud element 7*a* in the blade section longitudinal direction L4, in the direction towards the casing. The base platform 7*a*-B, front and rear sealing lips 7*a*-D1 and 7*a*-D2 and the adjacent casing form a small flow channel, which extends at the circumference of the rotor and through which cooling fluid is passed during operation of the turbine, in order to cool the shroud 7 and the adjacent casing. The cooling fluid is for this purpose, by way of example, passed through the blade section 4, in a known manner.

The outer shroud element 7*a* and the blade section 4 are generally formed integrally, as illustrated in FIG. 2 as well.

As is also illustrated in FIG. 2, the outer shroud elements 7*a* are normally positioned at the blade section tip in such a way that the center of gravity is balanced with respect to the respective blade root. This ensures that the centrifugal forces caused by rotation are introduced linearly via the blade root into the rotor shaft, without any significant lateral forces being induced. However, since modern blade sections are generally twisted and in some cases are also curved, this means that the shroud elements are not balanced symmetrically with respect to the respective blade section. The first platform section 7*a*-1 of the shroud element, which extends on one face of the blade section 4 (in this case the pressure face), is not the same as the other platform section 7*a*-2, which extends on the other face of the blade section 4 (in this case the suction face). This non-uniformity of the platform sections 7*a*-1 and 7*a*-2 is illustrated in FIG. 2 by the different projection lengths KL1 of the pressure-side platform section 7*a*-1 and KL2 of the suction-side platform section 7*a*-2 of the shroud element 7*a*.

When the rotor is rotating, the different projection lengths KL1 and KL2 result in bending torques of different magnitude acting on the pressure-side and suction-side platform sections 7*a*-1 and 7*a*-2. This situation is illustrated in FIG. 2 by the virtual center of gravity point M1 of the pressure-side platform section 7*a*-1 with the associated lever arm Y-M1, and the virtual center of gravity point M2 of the suction-side platform section 7*a*-2 with the associated lever arm Z-M2.

Figure 4:
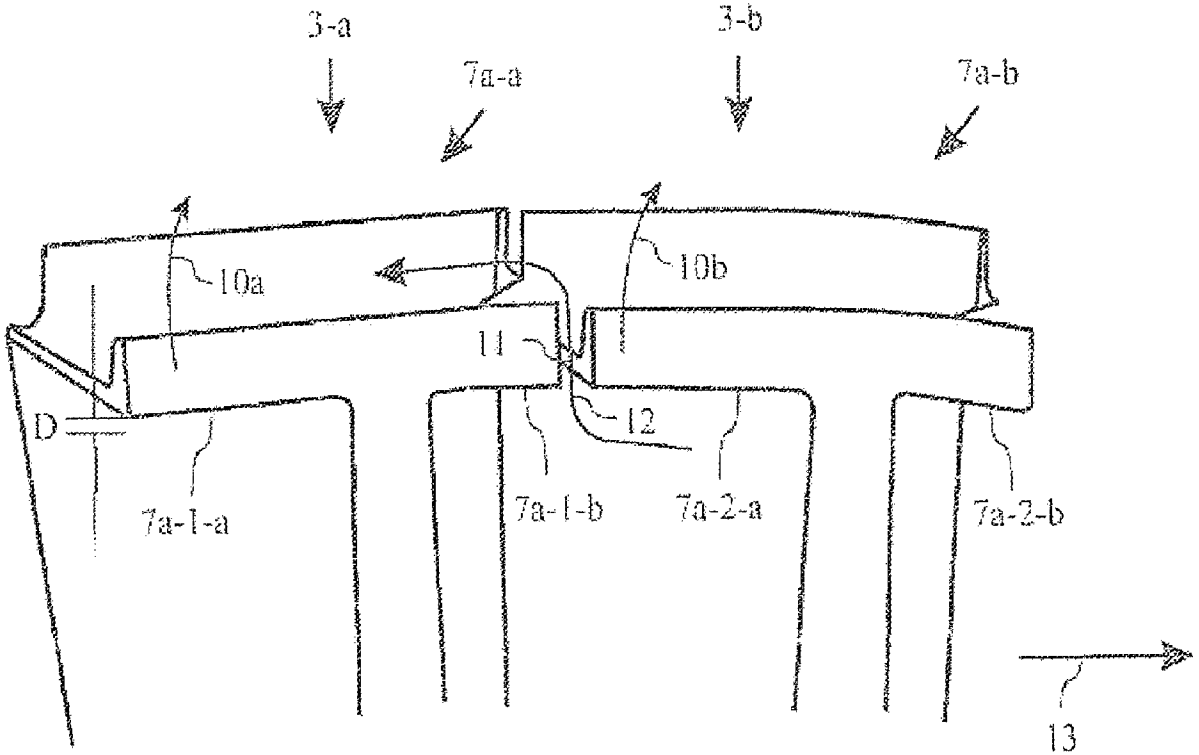
Fig. 4 PRIOR ART
FIG. 4 shows an illustration of the force and flow relationships which act on the shroud elements during operation of the rotor blade as shown in FIG. 2.

The different bending torque magnitudes on the pressure-side platform section 7*a*-1 and on the suction-side platform section 7*a*-2 result in different elastic deflections of the platform sections 7*a*-1 and 7*a*-2 during operation of the rotor. The deflection A of the pressure-side platform section 7*a*-1-*a* is shown in FIG. 4. FIG. 4 also shows bending torque arrows 10-*a* and 10-*b*, which act in the direction of the deflection. The pressure-side platform sections 7*a*-1-*a* and 7*a*-1-*b* bend to a greater extent than the suction-side platform sections 7*a*-2-*a* and 7*a*-2-*b* of the respectively adjacent shroud elements owing to the higher bending torque loads. This in each case results in a considerably larger gap 11 being formed between the pressure-side platform section and the suction-side platform section. The enlarged gap 11 allows the fluid to escape from the main flow into the cooling channel, as shown by the flow arrow 12 illustrated in FIG. 4. The flow of the fluid from the main flow into the enlarged gap 11 is in this case also exacerbated by the fluid additionally effectively being pressed into the gap as a result of the rotation in the rotation direction 13.

In the case of the blades 3, 3*a*, and 3*b*, which are illustrated in FIGS. 2-4 and are used in a rotor of a turbine, the high bending forces together with the high temperature of the fluid in the main flow lead to an accelerated time/creepage behavior of the platform sections. Once again, this applies in particular to the respective pressure-side platform sections 7*a*-1 as well as 7*a*-1-*a* and 7*a*-1-*b*, which are also subject to a greater bending torque, owing to the greater free projection lengths during operation. After a certain amount of time, this results in increased creepage-dependent deformation of the pressure-side platform sections. This increased creepage behavior is in turn directly coupled to the projection length, and leads to reinforcement and acceleration of the effect illustrated in FIG. 4.

As the component age increases, the gap 11 thus becomes ever larger leading to increased ingress of fluid into the main flow into the cooling channel, which is formed between the outer shroud and the casing behind the gap 11. As a result of the ingress of hot fluid, the cooling fluid that is introduced into the cooling channel is in the end no longer sufficient to keep the component temperature of the components which are adjacent to the cooling channel sufficiently low. This results in local or else complete material overheating and, in the end, to component destruction. The affected components and in particular the blades must therefore be replaced at regular intervals.

Figure 5:
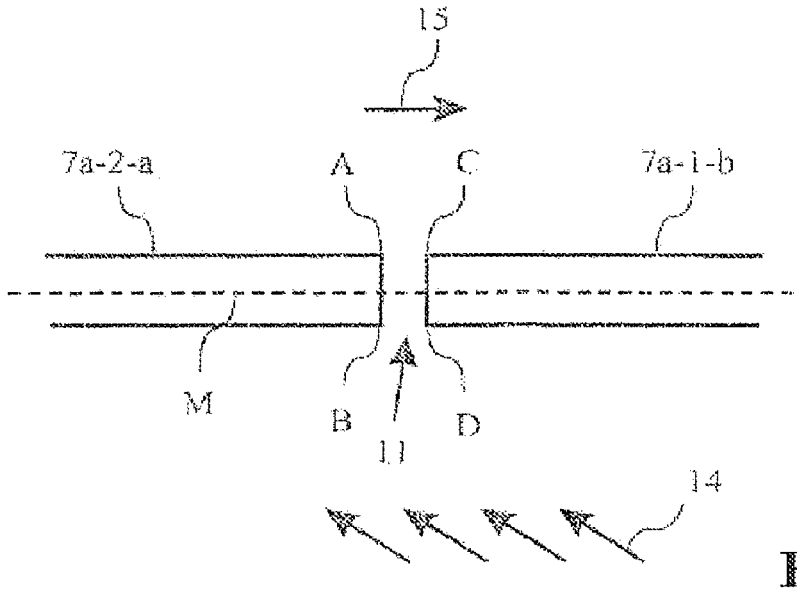
Fig. 5 PRIOR ART
FIG. 5 shows a schematic illustration of an arrangement, as known from the prior art, of platform sections of adjacent blades in the rest state.
Figure 6:
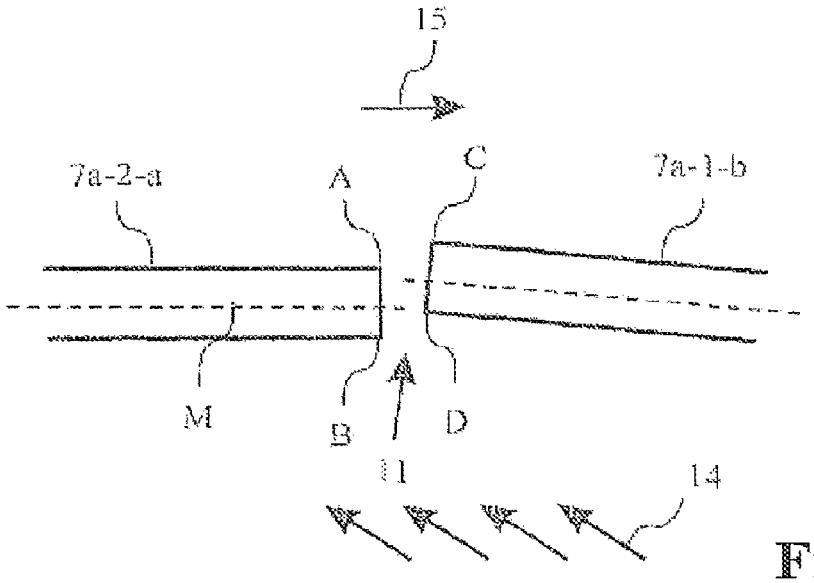
Fig. 6 PRIOR ART
FIG. 6 shows the arrangement as shown in FIG. 5 in the operating state.

This is where the invention comes into play. Once again in each case illustrated schematically, FIGS. 5 and 6 show the alignment of mutually adjacent platform sections 7*a*-2-*a* and 7*a*-1-*b* of two shroud elements of adjacent blades as shown in FIGS. 2 to 4. The respective left-hand platform section 7*a*-2-*a* in FIGS. 5 and 6 is the suction-side platform section of the shroud element of a first blade, while the respective right-hand platform section 7*a*-1-*b* of the pressure-side platform section of the shroud element of a second blade, which is adjacent to the first blade, is shown in FIGS. 5 and 6. The arrow 15 indicates the rotation direction of the blades, and the arrow 14 indicates the relative flow direction of the main flow. The platform sections 7*a*-2-*a* and 7*a*-1-*b* are essentially designed to be rectangular, together with the edge A facing away from the flow and the edge B facing the flow of the suction-side platform section 7*a*-2-*a*, as well as the edge C facing away from the flow and the edge D facing the flow of the pressure-side platform section 7*a*-1-*b*. In the cold, rest state, as shown in FIG. 5, the two platform sections 7*a*-2-*a* and 7*a*-1-*d* are arranged such that they are aligned with one another. The edge A is located immediately opposite the edge C, and the edge B is located immediately opposite the edge D. The gap 11 which results between the platform sections is of minimal size. However, once centrifugal forces act owing to rotation, leading to bending torques on the platform sections 7*a*-2-*a* and 7*a*-1-*b*, when the temperatures of the fluid of the main flow 14 are additionally very high, then this results in the situation illustrated in FIG. 6. The pressure-side platform section is deflected at a greater extent, so that the edges A-C and B-D are no longer opposite. On the one hand, this results in the gap length of the gap 11 being shortened and, as the pressure-side platform section bends even further, in the gap 11 between the platform sections becoming considerably larger. In any case, this results in it being easier for the hot fluid to enter the gap 11. The hot fluid from the main flow 14 passes to an increasing extent through the gap 11 to the rear face of the shroud elements.

Figure 7:
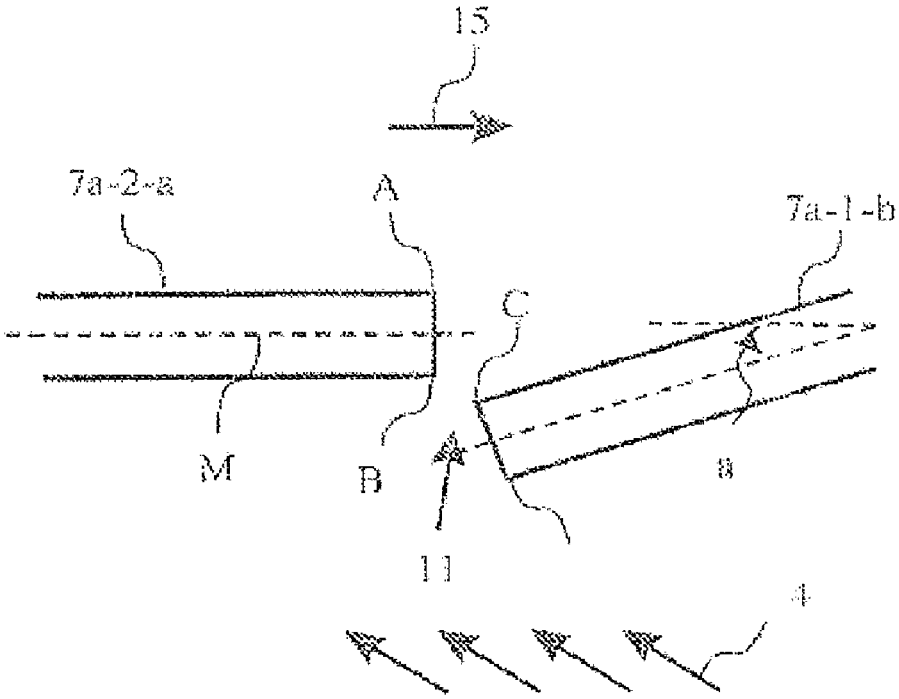
FIG. 7 shows a schematic illustration of an arrangement, designed according to the invention, of platform sections of adjacent blades in the rest state.
Figure 8:
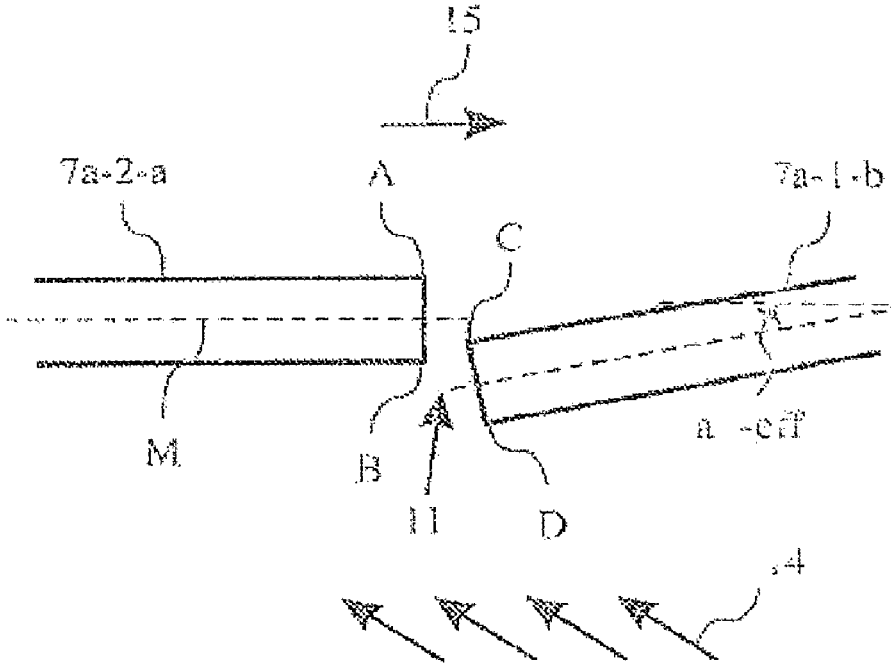
FIG. 8 shows the arrangement as shown in FIG. 7, in the operating state.

FIGS. 7 and 8 show a schematic illustration of a detail of a blade arrangement designed according to the invention. This illustration corresponds to the illustration in FIGS. 5 and 6. Once again, FIG. 7 shows a rest state and FIG. 8 shows a state during operation of the blade arrangement.

The blade arrangement illustrated in FIGS. 7 and 8 originates from a rotor for a turbine. As in the case of FIGS. 5 and 6 above, in FIGS. 7 and 8, the respective left-hand platform section is a suction-side platform section 7*a*-2-*a* of a shroud element of a first blade, while the respective right-hand platform section is a pressure-side platform section 7*a*-1-*b* of a shroud element of a second blade, which is adjacent to the first blade. The arrow 15 indicates the rotation direction of the blades, while the arrow 14 indicates the relative flow direction of the main flow. The blades are in each case produced integrally together with the shroud elements, as a casting. The pressure-side platform section 7*a*-1-*b* has a larger projection length than the suction-side platform section 7*a*-2-*a*, with the ratio of the projection length of the pressure-side platform section 7*a*-1-*b* to the projection length of the suction-side platform section 7*a*-2-*a* being approximately 1.2 in this case. The platform sections are essentially designed to be rectangular with the edge A facing away from the flow and the edge B facing the flow of the suction-side platform section and the edge C facing away from the flow as well as the edge D facing the flow of the pressure-side platform section. In the rest, cold state, which is illustrated in FIG. 7, the suction-side platform section 7*a*-2-*a* is designed conventionally, while the pressure-side platform section 7*a*-1-*b* is aligned at an additional inclination angle $\alpha$ with respect to the normal alignment of the platform section as illustrated in FIG. 5. The additional inclination angle $\alpha$ is for this purpose applied in the opposite direction to the bending torque which acts on the pressure-side platform section 7*a*-1-*b* during operation. The additional inclination angle $\alpha$ is accordingly and in the same way also applied in the opposite direction to the deflection of the pressure-side platform section 7*a*-1-*b* which occurs during operation. The edge C of the pressure-side platform section of the second blade in this case projects further into the area of the main flow 14 than the edge B facing the flow of the suction-side platform section of the first blade. In the rest, cold state of the rotor, the platform sections 7*a*-2-*a* and 7*a*-1-*b* are thus aligned offset with respect to one another, as they pass one another. As is illustrated in FIG. 7, this could also mean that the gap 11 between the platform sections is effectively larger in the rest and cold state than when the platform sections are arranged aligned, as is illustrated in FIG. 5.

Once the rotor is in operation, the centrifugal forces which act on the platform sections 7*a*-2-*a* and 7*a*-1-*b* result in the pressure-side platform section 7*a*-1-*b* being bent outwards. In consequence, the gap between the platform sections is closed, as illustrated in FIG. 8. The additional inclination angle $\alpha$ is in this case chosen such that an effective additional inclination angle $\alpha$-eff of more than 0° is produced during operation of the blade. In particular, in this case, the additional inclination angle $\alpha$ has been chosen such that an effective additional inclination angle $\alpha$-eff is produced during operation of the blade which is approximately equal to the additional inclination angle $\alpha$ which produces an additional effective inclination angle $\alpha$-eff of 0°. In this case, this means that the edge C facing away from the flow of the platform section which is arranged at an additional inclination angle is located between the edge B, facing the flow and the center plane M between the edge B facing the flow and the edge A facing away from the flow of the suction-side platform section 7*a*-2-*a* of the adjacent blade during operation of the blade arrangement.

The arrangement according to the invention as illustrated in FIGS. 7 and 8 has the advantage over the arrangements which are known from the prior art that the pressure-side platform section 7*a*-1-*b* is aligned with an offset $\alpha$ in the opposite sense to the centrifugal force bending. The centrifugal force bending which acts on the pressure-side platform section admittedly reduces the offset $\alpha$ to an effective offset $\alpha$-eff, although it does not initially return to zero. The offset is reduced only by the creepage behavior of the platform sections which occurs over time and is caused by the bending torque load with a high temperature load at the same time, finally leading to a negative effective inclination angle of the pressure-side platform section 7*a*-1-*b*. However, this takes considerably longer than in the case of the arrangement which is known from the prior art, so that the blades designed according to the invention can be used for a considerably longer operating time than the blades which are known from the prior art, as illustrated in FIGS. 2 to 6.

The illustration of the relative flow direction of the main flow 14 in FIGS. 5 and 6 as well as 7 and 8 also illustrates very well the fact that the main flow 14 is deflected in a suitable manner, without being passed into the gap 11 and the cavity located behind the shroud, only when the platform section 7*a*-1-*b* is aligned at an additional inclination angle. If, instead of this, the platform section 7*a*-2-*a* were to be aligned at an additional inclination angle, then the main flow 14 would strike the end face of the platform section 7*a*-2-*a*, and would thus be passed to an even greater extent into the gap 11 and into the cavity located behind the shroud.

The blade arrangement designed according to the invention and as described in conjunction with FIGS. 7 and 8 represents only one exemplary embodiment of the invention, which can in fact be modified by a person skilled in the art in many ways without any problems without departing from the idea of the invention.

Thus, for example, both platform sections of one shroud element may also be aligned at an additional inclination angle with respect to the normal alignment.

The invention can also be applied to an inner shroud element instead of to an outer shroud element. Furthermore, the blade may also be developed as a stator blade.

What is claimed is:

1. A blade for a turbomachine, comprising:

a blade section extending in a blade section longitudinal direction having a first end configured to connect to a rotor shaft and a second end; and an outer shroud element terminating the blade section in the blade section longitudinal direction at the second end, the shroud element extending essentially at right angles to the blade section longitudinal direction and having first and second platform sections projecting beyond the blade section and being asymmetric with respect to one another, wherein a greater bending torque acts on the first platform section than on the second platform section during operation of the blade, and wherein the first platform section is disposed at an additional inclination angle with respect to a normal alignment of the first platform section, the additional inclination angle being in an opposite direction to the bending torque acting on the first platform section during operation.

2. The blade as recited in claim 1, wherein the blade section has a pressure face and a suction face and the shroud element has a corresponding pressure side and a corresponding suction side, the first platform section being disposed on the pressure side, and the second platform section being disposed on the suction side of the shroud element.

3. The blade as recited in claim 2, wherein the first platform section has a first projection length larger than a second projection length of the second platform section.

4. The blade as recited in claim 1, wherein the additional inclination angle is chosen such that, during operation of the blade, an effective additional inclination angle of at least 0° is produced.

5. The blade as recited in claim 4, wherein the additional inclination angle is chosen such that the effective additional inclination angle during operation of the blade is more than 0°.

6. The blade as recited in claim 5, wherein the additional inclination angle is chosen such that the effective additional inclination angle produced during operation of the blade is approximately equal to a reference additional inclination angle that would result in a reference effective additional inclination angle of 0° being produced during operation of the blade.

7. The blade as recited in claim 1, wherein the blade section and shroud element are part of a single integral casting.

8. The blade as recited in claim 1, wherein the blade is a rotor blade of a turbine.

9. The blade as recited in claim 8, wherein the turbomachine is one of a gas turbine and a gas turbine set.

10. A blade arrangement comprising:

a plurality of blades disposed on a circumference of a turbomachine in a row with respect to one another, wherein each blade has a blade section and an outer shroud element terminating the blade section in a blade section longitudinal direction, the shroud elements of adjacent blades being adjacent to one another, wherein each blade section has a suction face and a pressure face, and each shroud element extends essentially at a right angle to the respective blade section longitudinal direction and has a first platform section projecting beyond the pressure face of the respective blade section and a second platform section projecting beyond the suction face of the respective blade section, wherein the first and second platform sections of each blade are asymmetric with respect to one another, wherein a greater bending torque acts on the first platform section of the blade during operation of the blade than on the second section, and wherein the first platform section of at least one blade is disposed at an additional inclination angle with respect to a normal alignment of the first platform section, the additional inclination angle being in an opposite direction to the bending torque acting on the first platform section during operation.

11. The blade arrangement as recited in claim 10, wherein the first platform section of all of the blades is disposed at the additional inclination angle.

12. The blade arrangement as recited in claim 10, wherein each of the platform sections are essentially rectangular at their free ends, with a first edge facing the flow and a second edge facing away from the flow, and wherein the additional inclination angle is chosen such that the second edge of the first platform section is disposed between the first edge and the second edge of the adjacent platform section of the adjacent blade during operation.

13. The blade arrangement as recited in claim 12, wherein the additional inclination angle is chosen such that the second edge of the first platform section is disposed between the first edge and a center plane between the first edge and the second edge of the adjacent platform section of the adjacent blade during operation.

14. The blade arrangement as recited in claim 12, wherein the additional inclination angle is chosen such that the second edge of the first platform section projects further into an area of the flow than the first edge of the adjacent platform section of the adjacent blade when the blade arrangement is not in operation.

15. The blade arrangement as recited in claim 10, wherein the blade arrangement is a rotor of a turbine.

* * * * *